US010650736B2

(12) United States Patent
Oulee et al.

(10) Patent No.: US 10,650,736 B2
(45) Date of Patent: May 12, 2020

(54) DISPLAY APPARATUS AND VOLTAGE CALIBRATION METHOD

(71) Applicant: Raydium Semiconductor Corporation, Hsinchu (TW)

(72) Inventors: Chi-Hsiang Oulee, Taitung (TW); Tzong-Yau Ku, Hsinchu (TW); Jun-Ren Shih, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 0 days.

(21) Appl. No.: 16/286,904

(22) Filed: Feb. 27, 2019

(65) Prior Publication Data

US 2019/0279561 A1 Sep. 12, 2019

Related U.S. Application Data

(60) Provisional application No. 62/640,062, filed on Mar. 8, 2018.

(51) Int. Cl.
*G09G 3/3208* (2016.01)

(52) U.S. Cl.
CPC ... *G09G 3/3208* (2013.01); *G09G 2310/0259* (2013.01); *G09G 2310/066* (2013.01); *G09G 2310/08* (2013.01)

(58) Field of Classification Search
CPC ..... G09G 3/3208; G09G 2310/0259; G09G 2310/066; G09G 2310/08
See application file for complete search history.

(56) References Cited

U.S. PATENT DOCUMENTS

| | | | | |
|---|---|---|---|---|
| 10,319,278 | B1 * | 6/2019 | Nho | G09G 3/2003 |
| 10,395,590 | B1 * | 8/2019 | Lin | G09G 3/3275 |
| 2001/0040548 | A1 * | 11/2001 | Ikeda | G09G 3/2011 345/92 |

* cited by examiner

*Primary Examiner* — Sejoon Ahn

(57) ABSTRACT

A display apparatus and a voltage calibration method are disclosed. The display apparatus includes a ramp voltage generator, a ramp counter and a timing controller. The ramp voltage generator is configured to generate a ramp voltage. The ramp counter is coupled to the ramp voltage generator and configured to start counting when the ramp voltage generator generates the ramp voltage. The timing controller is coupled to the ramp voltage generator and the ramp counter respectively. When the ramp voltage is increased to be equal to a reference voltage, the timing controller compares an instant count value of the ramp counter with a default value and selectively calibrates a rising slope of the ramp voltage generated by the ramp voltage generator according to a comparing result of the instant count value and the default value.

12 Claims, 3 Drawing Sheets

DISPLAY APPARATUS AND VOLTAGE CALIBRATION METHOD

BACKGROUND OF THE INVENTION

1. Field of the Invention

The invention relates to a display; in particular, to a display apparatus and a voltage calibration method.

2. Description of the Prior Art

Please refer to FIG. 1. FIG. 1 illustrates a schematic diagram of the driving method of the ramp source driver in the conventional display apparatus.

As shown in FIG. 1, in the conventional display apparatus using OLED On Silicon micro-display technology, the ramp source driver generates a ramp voltage VRAMP through a ramp voltage generator RVG and transmits the ramp voltage VRAMP to all data lines DL(X) through a buffer BF.

When the value counted by the ramp counter RCT is equal to the default value stored in the data register DTR (for example, both are N), the switch SW coupled between the buffer BF and the data line DL(X) is turned off immediately. At this time, the voltage on the data line DL(X) is the voltage value of the ramp voltage VRAMP generated by the ramp voltage generator RVG.

However, in fact, in this circuit architecture, the following factors may cause the voltage values sampled on the data line to be inconsistent.

At first, the ramp voltage generator RVG basically charges the fixed capacitor through a fixed current source to generate a ramp voltage VRAMP having a fixed rising slope (as shown in FIG. 2), thereby providing different gray scale voltages required for the display panel. However, since the current source and the capacitor will change with the variation of process, voltage and temperature, the ramp voltage VRAMP provided by different driving circuits will have different rising slopes, which needs to be improved.

In addition, the ramp counter RCT is coupled to the oscillator OSC, and the oscillator OSC provides oscillator frequency to the ramp counter RCT. Since the oscillator OSC also changes with the variation of process, voltage and temperature, the time at which the switch SW is turned off each time (for example, T shown in FIG. 2) is inconsistent, so that the ramp voltage values sampled on the data line DL(X) are also different and need to be improved.

SUMMARY OF THE INVENTION

Therefore, the invention provides a display apparatus and a voltage calibration method to solve the above-mentioned problems of the prior arts.

A preferred embodiment of the invention is a display apparatus. In this embodiment, the display apparatus includes a ramp voltage generator, a ramp counter and a timing controller. The ramp voltage generator is used to generate a ramp voltage. The ramp counter is coupled to the ramp voltage generator and starts counting when the ramp voltage generator generates the ramp voltage. The timing controller is coupled to the ramp voltage generator and the ramp counter respectively. When the ramp voltage is increased to be equal to a reference voltage, the timing controller compares an instant counting value of the ramp counter with a default value and selectively calibrates a rising slope of the ramp voltage generated by the ramp voltage generator according to a comparing result of the instant counting value and the default value.

In an embodiment, if the comparing result is that the instant counting value is equal to the default value, the timing controller maintains the rising slope of the ramp voltage unchanged.

In an embodiment, if the comparing result is that the instant counting value is larger than the default value, the timing controller increases the rising slope of the ramp voltage.

In an embodiment, if the comparing result is that the instant counting value is smaller than the default value, the timing controller decreases the rising slope of the ramp voltage.

In an embodiment, the timing controller is coupled to the ramp voltage generator and provides a slope control signal to the ramp voltage generator to selectively calibrate the rising slope of the ramp voltage generated by the ramp voltage generator.

In an embodiment, the display apparatus further includes a comparator. Two input terminals of the comparator are coupled to the ramp voltage generator and the reference voltage respectively. The comparator compares the ramp voltage with the reference voltage to determine whether the ramp voltage is increased to be equal to the reference voltage.

In an embodiment, the display apparatus further includes a D-type flip-flop. Two input terminals of the D-type flip-flop are coupled to an output terminal of the comparator and the ramp counter respectively. An output terminal of the D-type flip-flop is coupled to the timing controller. When the ramp voltage is increased to be equal to the reference voltage, the D-type flip-flop transmits the instant counting value provided by the ramp counter to the timing controller.

In an embodiment, the display apparatus further includes an oscillator coupled to the ramp counter and configured to provide an oscillating frequency to the ramp counter. The comparing result is related to the oscillating frequency.

Another preferred embodiment of the invention is a voltage calibration method. In this embodiment, the voltage calibration method is applied to a display apparatus. The display apparatus includes a timing controller, a ramp voltage generator and a ramp counter. When the ramp voltage generator generates a ramp voltage, the ramp counter starts counting.

The voltage calibration method includes the following steps of: (a) when the ramp voltage is increased to be equal to the reference voltage, recording an instant counting value of the ramp counter and transmitting the instant counting value to the timing controller; (b) the timing controller comparing the instant counting value with a default value; and (c) the timing controller selectively calibrating the rising slope of the ramp voltage generated by the ramp voltage generator.

Compared to the prior art, the display apparatus and the voltage calibration method of the invention can determine whether the rising slope of the ramp voltage generated by the ramp voltage generator is too low or too high (or whether the oscillating frequency of the oscillator is too fast or too slow) according to the comparing result between the instant counting value of the ramp counter and the default value when the ramp voltage is increased to be equal to the reference voltage and calibrate the rising slope of the ramp voltage accordingly, so that it can effectively improve the problem that the ramp voltage values sampled by different driving circuits at the display panel are varied due to process, voltage and temperature variations.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is a display apparatus. In this embodiment, the display apparatus includes a display panel, and the display panel can be an organic light-emitting diode (OLED) panel and can use the OLED On Silicon micro-display technology, but not limited to this.

Figure 1:
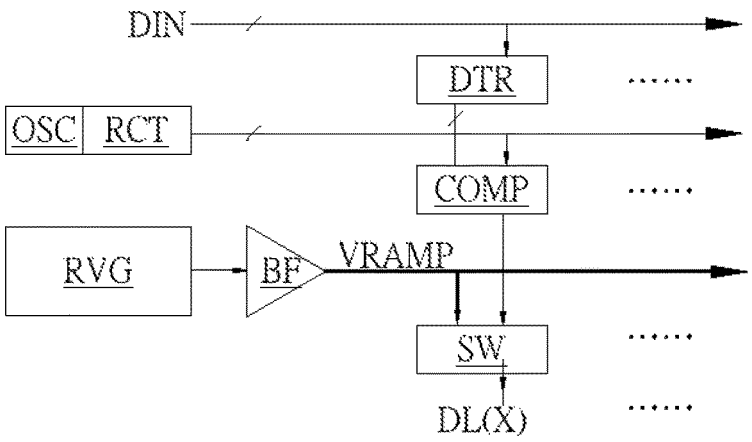
FIG. 1 (PRIOR ART)
FIG. 1 illustrates a schematic diagram of the driving method of the ramp source driver in the conventional display apparatus.
Figure 2:
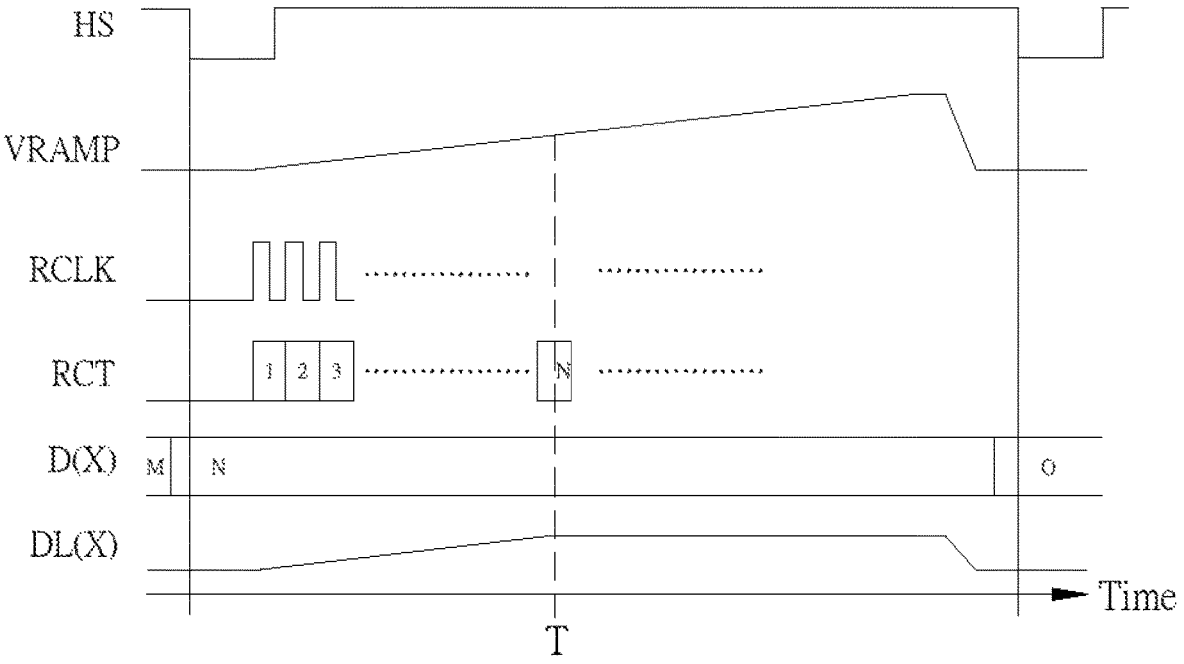
FIG. 2 (PRIOR ART)
FIG. 2 illustrates a schematic diagram showing that when the ramp voltage VRAMP having the fixed rising slope starts increasing, the ramp counter RCT starts counting from 1 and turns off the switch when the ramp counter RCT counts the default value N at the time T.
Figure 3:
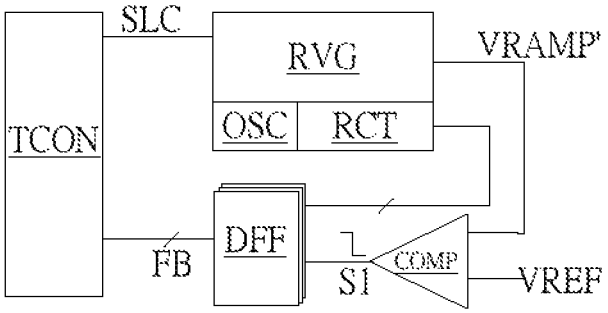
FIG. 3 illustrates a schematic diagram of the display apparatus in a preferred embodiment of the invention.

Please refer to FIG. 3. FIG. 3 illustrates a schematic diagram of the display apparatus in this embodiment.

As shown in FIG. 3, the display apparatus includes a timing controller TCON, a ramp voltage generator RVG, an oscillator OSC, a ramp counter RCT, a comparator COMP and a D-type flip-flop DFF. The timing controller TCON is coupled to the ramp voltage generator RVG; the ramp voltage generator RVG is coupled to one input terminal of the comparator COMP; the other input terminal of the comparator COMP is coupled to the reference voltage VREF; the output terminal of the comparator COMP and the ramp counter RCT are coupled to the two input terminals of the D-type flip-flop DFF respectively; the output terminal of the D-type flip-flop DFF is coupled to the timing controller TCON; the oscillator OSC is coupled to the ramp counter RCT.

In this embodiment, the ramp voltage generator RVG generates a digitally controlled ramp voltage VRAMP' to one input terminal of the comparator COMP and the digitally controlled ramp voltage VRAMP' is increased with time and has a fixed rising slope.

When the two input terminals of the comparator COMP receive the digitally controlled ramp voltage VRAMP' and the reference voltage VREF respectively, the comparator COMP compares the ramp voltage VRAMP' with the reference voltage VREF and determines whether the ramp voltage VRAMP' and the reference voltage VREF are equal.

When the comparator COMP determines that the digitally controlled ramp voltage VRAMP' is increased to be equal to the reference voltage VREF, a comparator output signal S1 outputted by the output terminal of the comparator COMP will be changed from the original low-level to high-level. When the comparator COMP determines that the digitally controlled ramp voltage VRAMP' has not been increased to be equal to the reference voltage VREF, the comparator output signal S1 outputted by the output terminal of the comparator COMP will maintain the original low-level.

The two input terminals of the D-type flip-flop DFF receive the comparator output signal S1 provided by the output of the comparator COMP and the instant counting value provided by the ramp counter RCT respectively. When the comparator output signal S1 is changed from the original low-level to high-level, it means that the digitally controlled ramp voltage VRAMP' is increased to be equal to the reference voltage VREF, and the D-type flip-flop DFF will generate a feedback signal FB according to the instant counting value provided by the ramp counter RCT and provide the feedback signal FB to the timing controller TCON.

At this time, the timing controller TCON can obtain the instant counting value of the ramp counter RCT when the digitally controlled ramp voltage VRAMP' is increased to be equal to the reference voltage.

Next, the timing controller TCON will compare the instant counting value of the ramp counter RCT with a default value, and selectively calibrate the rising slope of the digitally controlled ramp voltage VRAMP' generated by the ramp voltage generator RVG based on the comparing result. In fact, the timing controller TCON can provide a slope control signal SLC to the ramp voltage generator RVG to selectively calibrate the rising slope of the digitally controlled ramp voltage VRAMP' produced by the ramp voltage generator RVG.

Figure 4:
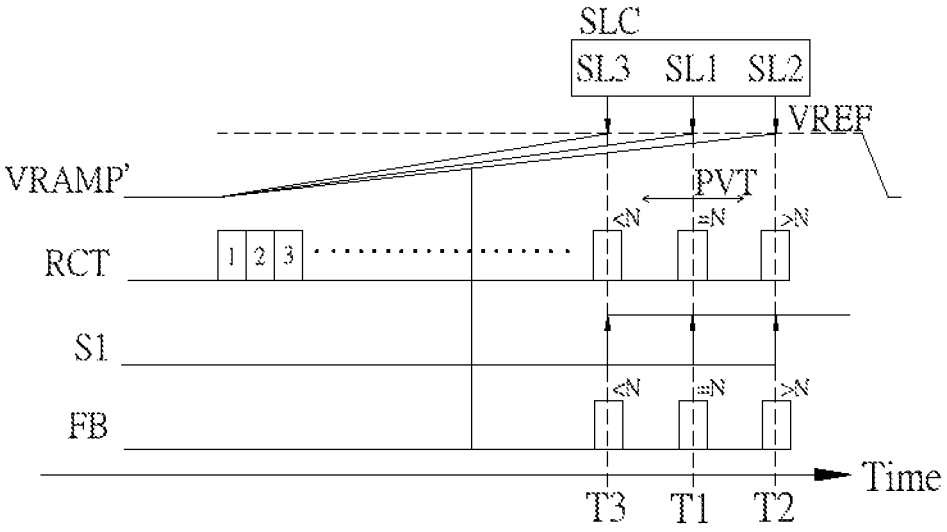
FIG. 4 illustrates a schematic diagram showing that when the ramp voltage is increased to be equal to the reference voltage, the timing controller of the invention compares the instant counting value of the ramp counter with the default value and determines whether the rising slope of the ramp voltage generated by the ramp voltage generator should be calibrated.

Please refer to FIG. 4. FIG. 4 illustrates a schematic diagram showing that when the digitally controlled ramp voltage VRAMP' is increased to be equal to the reference voltage VREF, the timing controller TCON of the invention compares the instant counting value of the ramp counter RCT with the default value N and determines whether the rising slope of the digitally controlled ramp voltage VRAMP' generated by the ramp voltage generator RVG should be calibrated.

When the digitally controlled ramp voltage VRAMP' starts to increase, the ramp counter RCT also starts counting from 1. When the digitally controlled ramp voltage VRAMP' is increased to be equal to the reference voltage VREF, the timing controller TCON compares the instant counting value of the ramp counter RCT with the default value N.

If the comparing result is that the instant counting value of the ramp counter RCT is equal to the default value N, it means that the rising slope SL1 of the digitally controlled ramp voltage VRAMP' is normal (or the oscillating frequency of the oscillator OSC is normal), the timing controller TCON will maintain the rising slope of the digitally controlled ramp voltage VRAMP' generated by the ramp voltage generator RVG.

If the comparing result is that the instant counting value of the ramp counter RCT is larger than the default value N, it means that the rising slope SL2 of the digitally controlled ramp voltage VRAMP' is too low (or the oscillating frequency of the oscillator OSC is too fast), the timing controller TCON will increase the rising slope of the digitally controlled ramp voltage VRAMP' generated by the ramp voltage generator RVG, so that the rising slope of the digitally controlled ramp voltage VRAMP can return to normal.

If the comparing result is that the instant counting value of the ramp counter RCT is smaller than the default value N, it means that the rising slope SL3 of the digitally controlled ramp voltage VRAMP' is too high (or the oscillating frequency of the oscillator OSC is too slow), the timing controller TCON will reduce the rising slope of the digitally controlled ramp voltage VRAMP' generated by the ramp voltage generator RVG, so that the rising slope of the digitally controlled ramp voltage VRAMP can return to normal.

Thereby, even if the values of the ramp voltage sampled by the different driving circuit at the display panel end may deviate from the normal value with process, voltage, temperature variation (as shown by the offset PVT in FIG. 4), the invention can still dynamically calibrate the rising slope of the digitally controlled ramp voltage VRAMP' generated by the ramp voltage generator RVG according to the comparing result between the instant counting value of the ramp counter RCT and the default value, so that the values of the digitally controlled ramp voltage VRAMP' sampled by the different driving circuit at the display panel end can be consistent.

Another embodiment of the invention is a voltage calibration method. In this embodiment, the voltage calibration method is applied to a display apparatus. The display apparatus includes a display panel, and the display panel may be an organic light-emitting diode (OLED) panel, and may use the OLED On Silicon micro-display technology, but not limited to this. The display apparatus also includes a timing controller, a ramp voltage generator and a ramp counter. When the ramp voltage generator generates a ramp voltage, the ramp counter starts counting.

Figure 5:
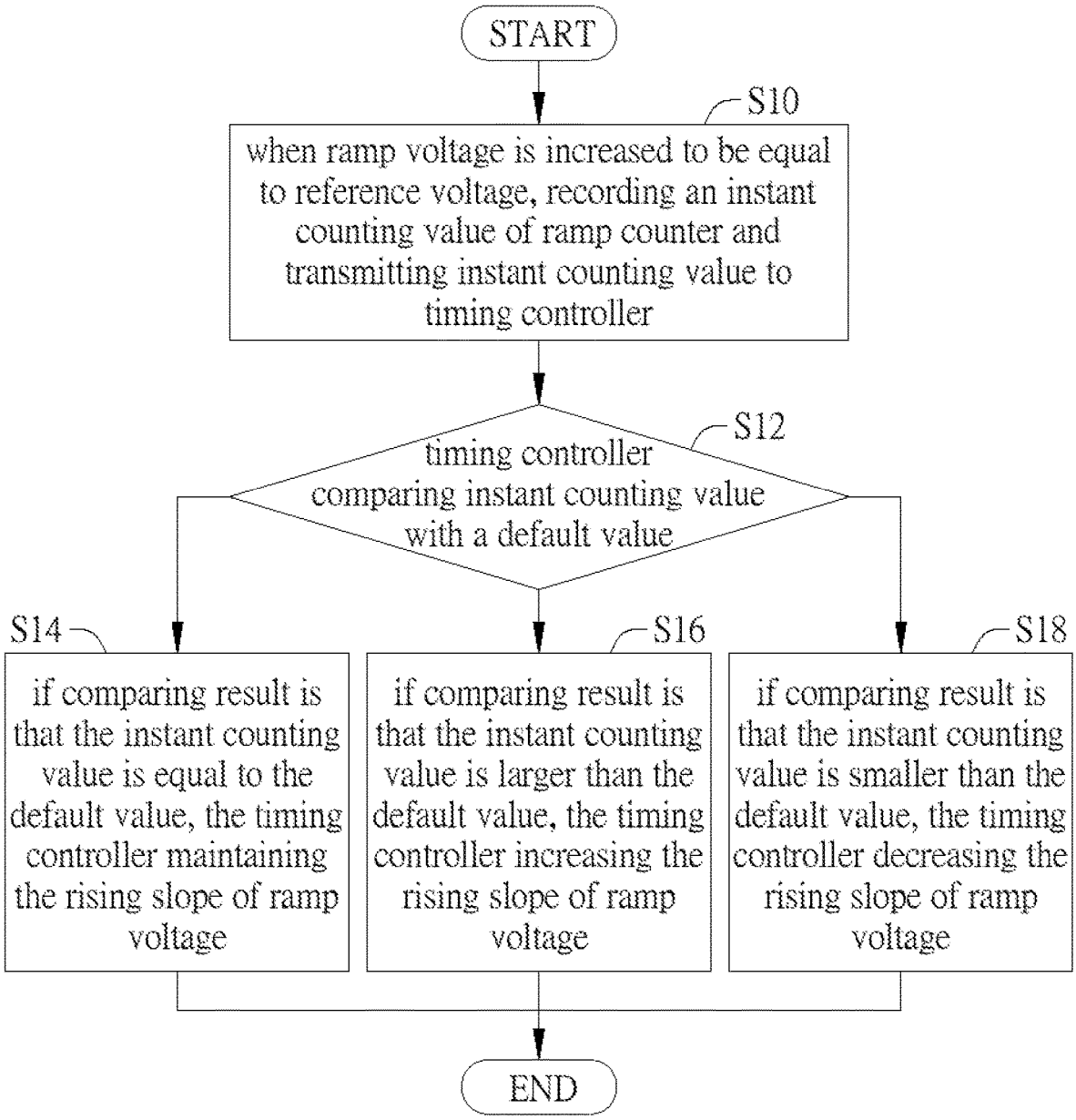
FIG. 5 illustrates a flowchart of the voltage calibration method in another preferred embodiment of the invention.

Please refer to FIG. 5. FIG. 5 illustrates a flowchart of the voltage calibration method in this embodiment.

As shown in FIG. 5, the voltage calibration method can include the following steps:

Step S10: when the ramp voltage is increased to be equal to the reference voltage, recording an instant counting value of the ramp counter and transmitting the instant counting value back to the timing controller;

Step S12: the timing controller comparing the instant counting value with a default value;

Step S14: if the comparing result is that the instant counting value is equal to the default value, the timing controller maintaining the rising slope of the ramp voltage unchanged;

Step S16: if the comparing result is that the instant counting value is larger than the default value, the timing controller increasing the rising slope of the ramp voltage; and Step S18: if the comparing result is that the instant counting value is smaller than the default value, the timing controller decreasing the rising slope of the ramp voltage.

Thereby, even if the values of the ramp voltage sampled by the different driving circuit at the display panel end may deviate from the normal value with process, voltage, temperature variation, the voltage calibration method of the invention can still dynamically calibrate the rising slope of the ramp voltage according to the comparing result between the instant counting value of the ramp counter and the default value, so that the values of the ramp voltage sampled by the different driving circuit at the display panel end can be consistent.

In practical applications, the timing controller can be coupled to the ramp voltage generator and provide a slope control signal to the ramp voltage generator to selectively calibrate the rising slope of the ramp voltage generated by the ramp voltage generator.

In addition, the display apparatus can further include a comparator. The two input terminals of the comparator are coupled to the ramp voltage generator and the reference voltage respectively. The comparator compares the ramp voltage with the reference voltage to determine whether the ramp voltage is increased to be equal to the reference voltage.

Further, the display apparatus can further include a D-type flip-flop. The two input terminals of the D-type flip-flop are coupled to the output terminal of the comparator and the ramp counter respectively. The output terminal of the D-type flip-flop is coupled to the timing controller. When the ramp voltage is increased to be equal to the reference voltage, the D-type flip-flop will transmit the instant counting value provided by the ramp counter back to the timing controller.

Furthermore, the display apparatus can further include an oscillator. The oscillator is coupled to a ramp counter to provide an oscillating frequency to the ramp counter. The comparing result of the step S12 is related to the oscillating frequency of the oscillator.

Compared to the prior art, the display apparatus and the voltage calibration method of the invention can determine whether the rising slope of the ramp voltage generated by the ramp voltage generator is too low or too high (or whether the oscillating frequency of the oscillator is too fast or too slow) according to the comparing result between the instant counting value of the ramp counter and the default value when the ramp voltage is increased to be equal to the reference voltage and calibrate the rising slope of the ramp voltage accordingly, so that it can effectively improve the problem that the ramp voltage values sampled by different driving circuits at the display panel are varied due to process, voltage and temperature variations.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A display apparatus, comprising:

a ramp voltage generator, configured to generate a ramp voltage;

a ramp counter, coupled to the ramp voltage generator and configured to start counting when the ramp voltage generator generates the ramp voltage; and a timing controller, coupled to the ramp voltage generator and the ramp counter respectively, when the ramp voltage is increased to be equal to a reference voltage, the timing controller comparing an instant counting value of the ramp counter with a default value and selectively calibrating a rising slope of the ramp voltage generated by the ramp voltage generator according to a comparing result of the instant counting value and the default value, wherein the display apparatus further comprises a comparator; two input terminals of the comparator are coupled to the ramp voltage generator and the reference voltage respectively; the comparator is configured to compare the ramp voltage with the reference voltage to determine whether the ramp voltage is increased to be equal to the reference voltage, and wherein the display apparatus further comprises a D-type flip-flop; two input terminals of the D-type flip-flop are coupled to an output terminal of the comparator and the ramp counter respectively; an output terminal of the D-type flip-flop is coupled to the timing controller; when the ramp voltage is increased to be equal to the reference voltage, the D-type flip-flop transmits the instant counting value provided by the ramp counter to the timing controller.

2. The display apparatus of claim 1, wherein if the comparing result is that the instant counting value is equal to the default value, the timing controller maintains the rising slope of the ramp voltage.

3. The display apparatus of claim 1, wherein if the comparing result is that the instant counting value is larger than the default value, the timing controller increases the rising slope of the ramp voltage.

4. The display apparatus of claim 1, wherein if the comparing result is that the instant counting value is smaller than the default value, the timing controller decreases the rising slope of the ramp voltage.

5. The display apparatus of claim 1, wherein the timing controller is coupled to the ramp voltage generator and configured to provide a slope control signal to the ramp voltage generator to selectively calibrate the rising slope of the ramp voltage generated by the ramp voltage generator.

6. The display apparatus of claim 1, wherein the display apparatus further comprises an oscillator coupled to the ramp counter and configured to provide an oscillating frequency to the ramp counter; the comparing result is related to the oscillating frequency.

7. A voltage calibration method, applied to a display apparatus, the display apparatus comprising a timing controller, a ramp voltage generator and a ramp counter, when the ramp voltage generator generates a ramp voltage, the ramp counter starting counting, the voltage calibration method comprising steps of:

(a) when the ramp voltage is increased to be equal to the reference voltage, recording an instant counting value of the ramp counter and transmitting the instant counting value to the timing controller;

(b) the timing controller comparing the instant counting value with a default value; and (c) the timing controller selectively calibrating the rising slope of the ramp voltage generated by the ramp voltage generator, wherein the display apparatus further comprises a comparator; two input terminals of the comparator are coupled to the ramp voltage generator and the reference voltage respectively;

the comparator is configured to compare the ramp voltage with the reference voltage to determine whether the ramp voltage is increased to be equal to the reference voltage, and wherein the display apparatus further comprises a D-type flip-flop; two input terminals of the D-type flip-flop are coupled to an output terminal of the comparator and the ramp counter respectively; an output terminal of the D-type flip-flop is coupled to the timing controller; when the ramp voltage is increased to be equal to the reference voltage, the D-type flip-flop transmits the instant counting value provided by the ramp counter to the timing controller.

8. The voltage calibration method of claim 7, wherein if the comparing result of the step (b) is that the instant counting value is equal to the default value, then the timing controller maintains the rising slope of the ramp voltage in the step (c).

9. The voltage calibration method of claim 7, wherein if the comparing result of the step (b) is that the instant counting value is larger than the default value, then the timing controller increases the rising slope of the ramp voltage in the step (c).

10. The voltage calibration method of claim 7, wherein if the comparing result of the step (b) is that the instant counting value is smaller than the default value, the timing controller decreases the rising slope of the ramp voltage in the step (c).

11. The voltage calibration method of claim 7, wherein the timing controller is coupled to the ramp voltage generator and configured to provide a slope control signal to the ramp voltage generator to selectively calibrate the rising slope of the ramp voltage generated by the ramp voltage generator.

12. The voltage calibration method of claim 7, wherein the display apparatus further comprises an oscillator coupled to the ramp counter and configured to provide an oscillating frequency to the ramp counter; the comparing result of the step (b) is related to the oscillating frequency.

* * * * *